United States Patent [19]

Warren et al.

[11] 4,181,869

[45] Jan. 1, 1980

[54] TUNGSTEN HALOGEN LAMP IN REFLECTOR ENVELOPE

[75] Inventors: Bernard J. Warren, Hillsboro, N.H.; Peter R. Gagnon, Salem, Mass.

[73] Assignee: GTE Sylvania Incorporated, Stamford, Conn.

[21] Appl. No.: 883,863

[22] Filed: Mar. 6, 1978

[51] Int. Cl.[2] ..... H01K 1/22; H01K 1/28; H01K 1/36

[52] U.S. Cl. ..... 313/315; 313/113; 313/331; 313/332

[58] Field of Search ..... 313/331, 332, 113, 315

[56] References Cited

U.S. PATENT DOCUMENTS

| | | | |
|---|---|---|---|
| 2,004,680 | 6/1935 | Volmer | 313/332 X |
| 2,121,638 | 6/1938 | Lemmers | 313/113 X |
| 2,414,604 | 1/1947 | Newcombe | 313/332 |
| 3,010,045 | 11/1961 | Plagge et al. | 313/113 |
| 3,354,343 | 11/1967 | Myers | 313/113 |
| 3,936,686 | 2/1976 | Moore | 313/113 |

*Primary Examiner*—Saxfield Chatmon, Jr.
*Attorney, Agent, or Firm*—James Theodosopoulos

[57] ABSTRACT

An electric lamp comprises a reflector envelope having a sealed tungsten-halogen lamp disposed therein. The lead-in conductor supports for the lamp extend through, and are connected to, metal eyelets which extend through holes in the reflector and are fastened to the reflector.

5 Claims, 3 Drawing Figures

TUNGSTEN HALOGEN LAMP IN REFLECTOR ENVELOPE

BACKGROUND OF THE INVENTION

This invention is concerned with electric lamps which comprise a tungsten-halogen lamp within a reflector envelope. Examples of such lamps are automobile headlights such as are shown in U.S. Pat. Nos. 3,784,807 and 4,011,642. It is particularly concerned with the lead-in conductors that extend through the reflector. In the prior art, the lead-in conductor was brazed or soldered to a metal ferrule that was glass-to-metal sealed to the glass reflector. Such a seal, shown in U.S. Pat. No. 3,364,378, required heating the glass to its softening point. Such heating is undesirable since it can distort the glass reflector. One purpose of this invention is to provide a lead-in conductor sealed to a glass reflector without the need of softening the glass.

SUMMARY OF THE INVENTION

A sealed tungsten-halogen lamp is disposed within a glass or plastic reflector envelope. Each lead-in conductor for the lamp extends through and is connected to a metal eyelet which passes through a hole in the reflector and which is flattened, peened or spun over to secure it to the reflector. The space between the eyelet and the reflector can be filled with an adhesive.

DESCRIPTION OF PREFERRED EMBODIMENT

Figure 1:
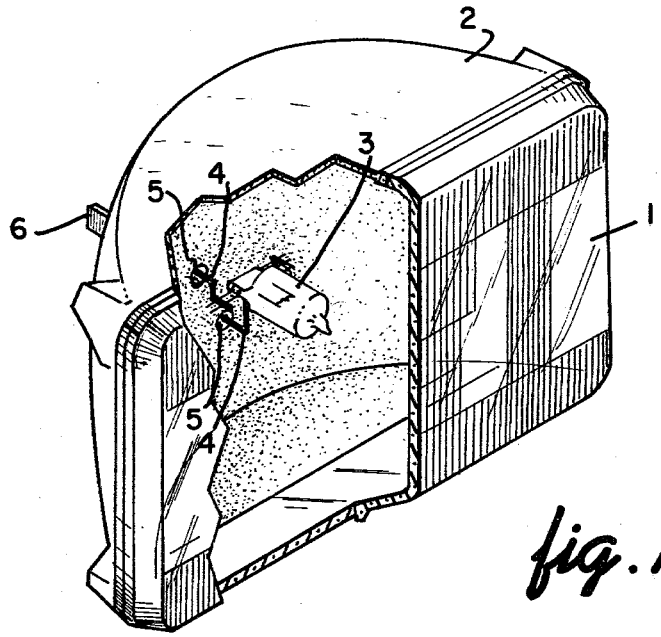
FIG. 1 is a perspective view, partly in section, of a reflector lamp in accordance with this invention.

A reflector lamp in accordance with this invention, as shown in FIG. 1, comprises a glass or plastic lens 1 bonded to the front of a curved, usually parabolic, glass or plastic reflector 2 and in which a tungsten-halogen lamp 3 is disposed. Lamp 3 can be a hard glass type of tungsten-halogen lamp, as shown, for example, in U.S. Pat. No. 3,829,729. Lead-in conductors 4 support lamp 3 and extend through holes 5 in reflector 2. Each lead-in conductor 4 is connected to a contact lug 6 on the back of reflector 2.

Figure 2:
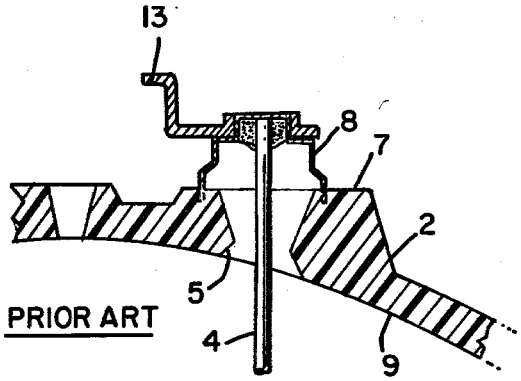
FIG. 2 is an expanded sectional view of the prior art seal of a lead-in conductor in a reflector.

FIG. 2 shows how lead-in conductor 4 was sealed to reflector 2 in the prior art. Landed surface 7 of reflector 2 was heated to its softening point and cup shaped metal ferrule 8 was pressed into the softened glass. After ferrule 8 was embedded in the glass, a reflective coating 9 was applied to the interior surface of reflector 2. This had to be done after installation of ferrules 8 because the high temperature involved in the ferrule installation would have a tendency to oxidize reflective coating 9 (generally aluminum). Lead-in conductor 4 was then attached to ferrule 8 by partially filling the ferrule with brazing material, inserting lead-in conductor 4 through hole 5 into ferrule 8, and then heating ferrule 8 sufficiently to cause the brazing material to fuse lead-in conductor 4 to ferrule 8. Finally, contact lug 13 was connected to the outside of ferrule 8, generally by soldering. The problem with this construction is that the softening of the glass in order to embed ferrules 8 could distort the reflector surface from its desired parabolic or other contour in the highly critical area near the light source, lamp 3.

Figure 3:
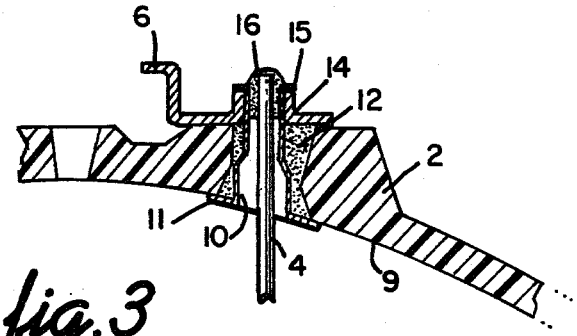
FIG. 3 is a similar view of a seal as per this invention.

The seal of a lamp as per this invention is shown in FIG. 3. First, a metal eyelet 10 having a head 11 at one end thereof is inserted through hole 5 of reflector 2 from the inside of reflector 2. Head 11 is formed at an angle to the axis of eyelet 10 so as to approximately conform to the reflector curvature. The body of eyelet 10 can be formed in two or more diameters, the larger one to maintain concentricity with hole 5 and the smaller one to maintain concentricity of lead-in conductor 4 and to provide the correct diameter for setting the eyelet. Contact lug 6 serves to provide electrical connection to an external electric power source. The function of eyelet 10, then, is to hold lug 6 securely in place and to provide a rigid point to which lead-in conductor 4 may be attached. The assembly procedure is simply to insert eyelet 10 through reflector 2, apply adhesive 12 in the annular area around eyelet 10 (to provide more rigidity and an effective seal), slip lug 6 in place and set eyelet 10 in a conventional fashion. For this purpose, lug 6 has a hole therethrough with a tubular wall 14 thereat, into which the smaller diameter of eyelet 10 fits and extends beyond. Eyelet 10 is set by spinning over, flattening or peening the end thereof onto lug 6, as shown at 15. The final step in the assembly is to apply solder 16 in order to solder lead-in conductor 4 to eyelet 10 and lug 6, so as to hold lamp 3 in a desired position and to provide a dependable electrical connection. Reflective coating 9 may be applied either before or after eyelets 10 are installed. Subsequently, lens 1 is bonded to reflector 2.

In one example, eyelet 10 was made of 10 mil thick brass, had a head diameter of 313 mils at an angle of 15 degrees, had a larger portion diameter of 188 mils and smaller portion diameter of 121 mils. The length was $\frac{3}{8}$ inch. Hole 5 was slightly tapered but its minimum diameter was about 225 mils. The thickness of the glass at hole 5 was about 3/16 inch. Contact lug 6 was made of 30 mil thick brass. The hole through lug 6 was 125 mils diameter and the height of wall 14 was 106 mils. Lead-in conductor 4 was 70 mils in diameter. Tungsten-halogen lamp 3 was rated at 36 watts, 12 volts.

We claim:

1. A reflector electric lamp comprising: a curved glass reflector; a sealed tungsten-halogen lamp disposed within the reflector; a metal eyelet extending through a hole in the reflector and fastened to the reflector, the inner end of the eyelet having an angled head thereon shaped to approximately conform to the reflector curvature; and a lead-in conductor, one end of which is connected to, and supports, the tungsten-halogen lamp, and the other end of which extends through, and is connected to, the eyelet.

2. A reflector electric lamp comprising: a curved glass reflector a sealed tungsten-halogen lamp disposed within the reflector; a metal eyelet extending through a hole in the reflector and fastened to the reflector; and a lead-in conductor, one end of which is connected to, and supports, the tungsten-halogen lamp, and the other end of which extends through, and is connected to, the eyelet, said eyelet comprising at least a larger diameter portion and a smaller diameter portion, the larger diameter portion providing concentricity of the eyelet in the reflector hole, and the smaller diameter portion providing concentricity of the lead-in conductor in the eyelet.

3. A reflector electric lamp comprising: a curved glass reflector having a predetermined thickness; a sealed tungsten-halogen lamp disposed within the reflector; a metal eyelet extending completely through a hole in the reflector and fastened to the reflector, there being a space between the eyelet and the sides of said hole; a lead-in conductor, one end of which is connected to and supports, the tungsten-halogen lamp, and the other end of which extends through, and is connected to, the eyelet; and an adhesive filling the space between the eyelet and the sides of the hole for the entire thickness of the reflector.

4. A reflector electric lamp comprising: a curved glass reflector; a sealed tungsten-halogen lamp disposed within the reflector; a metal eyelet having an external end and extending completely through a hole in the reflector and fastened to the reflector; a lead-in conductor, one end of which is connected to, and supports, the tungsten-halogen lamp, and the other end of which extends through, and is connected to, said eyelet; and an external contact lug having a hole therethrough, the external end of the eyelet protruding through said hole in the external contact lug and being flattened over to secure both the external contact lug and the eyelet to the reflector.

5. The lamp of claim 1 wherein the space between the lead-in conductor and the smaller diameter portion of the eyelet is sealed with solder.

* * * * *